United States Patent [19]

Lauderbach

[11] Patent Number: 4,706,333

[45] Date of Patent: Nov. 17, 1987

[54] GAS SPRINGS WITH DIFFERENT ACTIVE LENGTHS TO PROVIDE PLURAL STABLE STOPPING POSITIONS

[75] Inventor: Leo Lauderbach, Steinbach, Fed. Rep. of Germany

[73] Assignee: Stabilus GmbH, Fed. Rep. of Germany

[21] Appl. No.: 835,268

[22] Filed: Mar. 3, 1986

[30] Foreign Application Priority Data

Mar. 15, 1985 [DE] Fed. Rep. of Germany ..... 3509315

[51] Int. Cl.[4] ..... E05F 1/10

[52] U.S. Cl. ..... 16/289; 16/278; 16/DIG. 36

[58] Field of Search ..... 16/289, 66, 278, 255, 16/70, 56, 1 C, DIG. 36, 223; 296/56, 57 A, 37.16, 76, 146; 267/64.25, 120, 64.11; 188/272; 220/335, 336

[56] References Cited

U.S. PATENT DOCUMENTS 4,230,309 10/1980 Schnitzius ..... 16/66

4,415,194 11/1983 Bauer ..... 296/56

FOREIGN PATENT DOCUMENTS 2513302 3/1975 Fed. Rep. of Germany .

2849267 5/1980 Fed. Rep. of Germany .

*Primary Examiner*—Nicholas P. Godici

*Assistant Examiner*—G. M. Reid

*Attorney, Agent, or Firm*—Brumbaugh Graves Donohue & Raymond

[57] ABSTRACT

In an arrangement of gas springs as weight counter-balance and retaining device for a part pivotable substantially about a horizontal axis such as a flap, lid or door, a simple construction is required which guarantees two stable open positions for the pivotable part. This is guaranteed in that two gas springs are arranged where the first of the two gas springs possesses an outward thrust force acting over the entire range of displacement of the pivotable part, while the second gas spring possesses an outward thrust force acting over a part of the displacement range and an additional force-free displacement range.

10 Claims, 3 Drawing Figures

GAS SPRINGS WITH DIFFERENT ACTIVE LENGTHS TO PROVIDE PLURAL STABLE STOPPING POSITIONS

BACKGROUND OF THE INVENTION

The invention relates to an arrangement of gas springs as weight counter-balance and holding device for parts pivotable essentially about a horizontal axis, such as flaps, lids or doors, which are held in at least one open position.

STATEMENT OF THE PRIOR ART

For such pivotable parts the arrangement of two gas springs is known. Likewise it is known from Fed. German Publ. Spec. No. 2,513,302 to provide gas springs with a stroke-dependently acting locking device in order that upwardly pivotable parts may be held in different open positions. The locking device is formed in that transfer passages arranged in the interior of the gas spring are closed in dependence upon stroke. In order to obtain a greater angle of opening, a force has to be exerted in the opening direction upon the pivotable part in order to move past the closed section of the transfer passages. Especially in the case of relatively light pivotable parts, both the hinges and the points of articulation of the gas springs must be more strongly dimensioned so that without damage they can take up even the forces applied to overcome the locking device.

OBJECT OF THE INVENTION

It is the object of the present invention to avoid the disadvantages of the known constructions and to obtain an arrangement of gas springs as weight counterbalance and holding device for at least two open positions of a part pivotable about a horizontal axis, where both the hinges and the articulation points of the gas springs can be kept most extensively free from additional actuation forces.

SUMMARY OF THE INVENTION

In accordance with the invention the above defined object is solved in that the first of the two gas springs comprises an outward thrust force acting over the entire range of displacement of the pivotable part, while the second gas spring possesses an outward trust force acting over a part of the range of displacement and an additional force-free displacement range. By reason of the geometrical conditions of the articulation points of the gas spring and the open position of the pivotable part this achieves the object that in a first open position the outward thrust force of the first gas spring is effective while the second gas spring is at the end of the displacement range acting with outward thrust force. Thus the pivotable part is held in this first open position by the outward thrust forces of both gas springs. Further opening of the pivotable part about the horizontal axis requires a slight supporting of the outward thrust force of the first gas spring, while the second gas spring is working in the additional force-free displacement range. In the fully opened position the outward thrust force of the first gas spring suffices so that the pivotable part may be held securely. This is achieved in accordance with the invention in that the length of the second gas spring, when the piston rod is fully extended out of the cylinder, corresponds to an open position of the pivotable part. The maximum open position of the pivotable part is obtained in that the displacement of the first gas spring acting with outward thrust force is fully utilized and the second gas spring is not exerting any outward thrust force since it is in the force-free displacement range.

According to one feature a very advantageous form of embodiment is obtained in that the force-free displacement range of the second gas spring is formed by a sleeve capable of sliding on a gas spring part and articulatedly connected with a part.

The various featues of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

The invention will be explained in greater detail below by reference to the example of embodiment illustrated in the drawing. In detail.

DESCRIPTION OF THE PREFERRED EMBODIMENT

Figure 1:
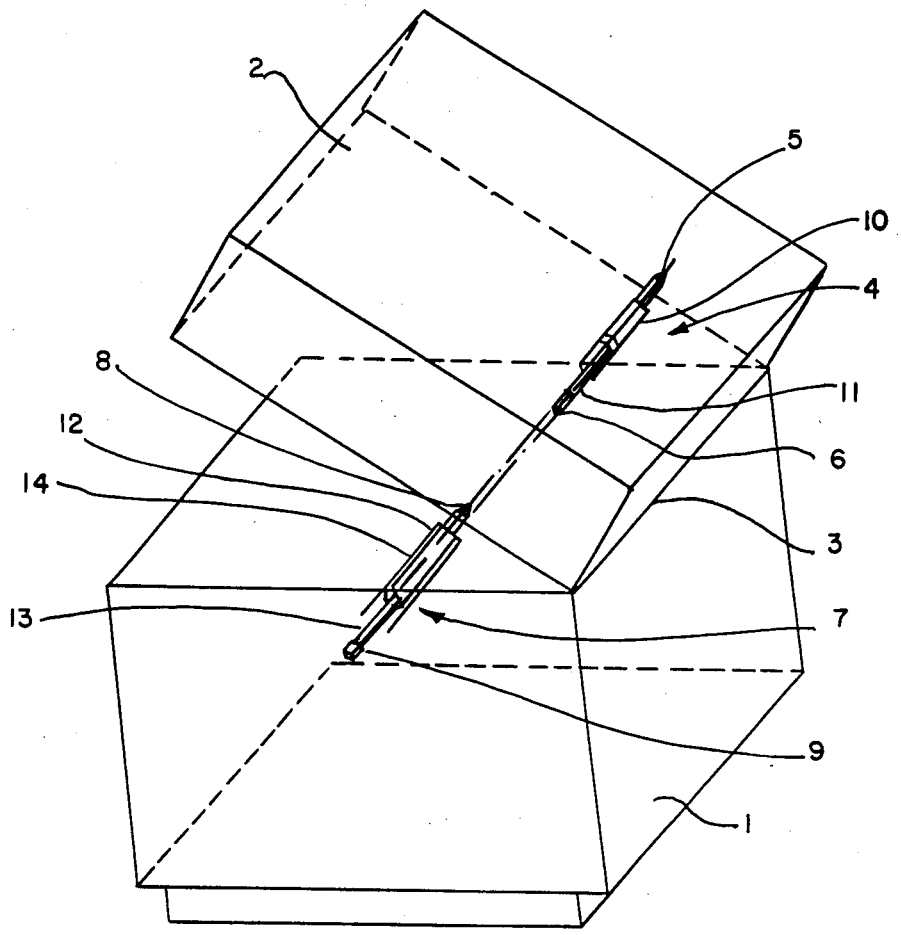
FIG. 1 shows a part pivotable about a horizontal axis, in a first stable holding position.

The Figures show a housing 1 which is provided with a lid 2 having a horizontal pivot axis 3. A first gas spring 4 is arranged with a joint 5 on the lid 2 and with the joint 6 on the housing 1. The joints 5 and 6 are formed for example by a journal situated on the lid 2 or on the housing 1, with which in each case there engages a joint eye of the gas spring 4. The gas spring 4 is formed as compressed-gas spring and possesses a cylinder 10 containing a gas filling under pressure, while a piston rod 11 is guided axially movably and with sealing to the exterior in the cylinder 10. On the other side of the lid 2 a second gas spring 7 is arranged which is connected through the joint 8 with the lid 2 and through the joint 9 with the housing 1. A joint eye for the joint 8 is secured to the end part of a sleeve 12 and this sleeve 12 is arranged axially displaceably on a cylinder 14 of the second gas spring 7. In this cylinder 14 there is a gas filling under pressure, while a piston rod 13 is guided axially movably and with sealing to the exterior in this cylinder 14 and carries at its outer end a joint eye for the joint 9. A force-free displacement range 15 is obtained by the axial mobility of the sleeve 12 on the cylinder 14.

Figure 2:
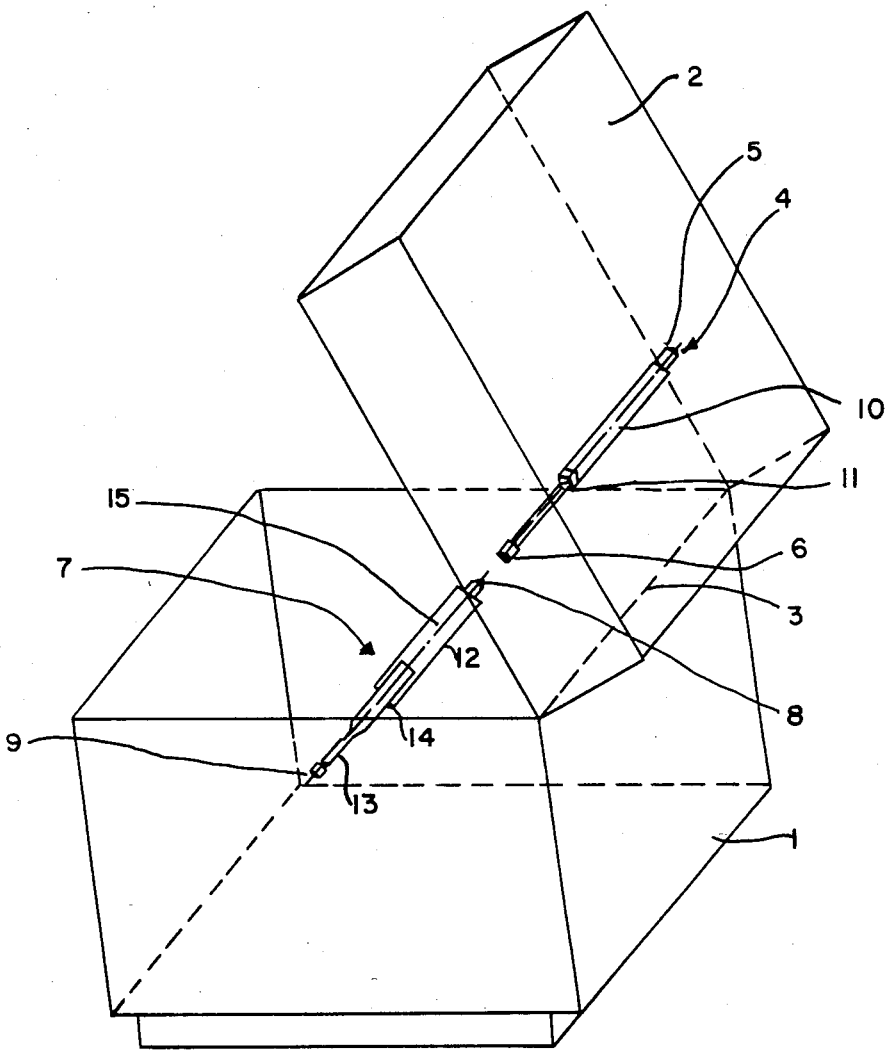
FIG. 2 shows the pivotable part in the fully opened, second stable holding position

The housing 1 with lid 2 as illustrated in the Figures is intended for example for a copying apparatus where the requirement exists that a first open position of the lid 2 is available for drying out over-night, while for the maintenance or repair of the copying apparatus a second open position with greater angle of opening is necessary. In order to obtain the first open position the lid 2 is briefly lifted, and then the outward thrust forces of the gas springs 4 and 7 push this lid 2 upwards until the piston rod 13 of the second gas spring 7 reaches the maximum outward thrust distance from the cylinder 14 (FIG. 1). Since the outward thrust force of the gas spring 4 does not alone suffice to open the lid 2 further, now a first stable open position is reached (FIG. 1). The outward thrust force of the gas spring 4 is designed so that it suffices to hold the lid 2 in the desired maximum open position (FIG. 2). In order to reach this second open position—starting from the first open position—the lid 2 is raised by hand, the outward thrust force of the gas spring 4 supporting this opening movement, while as regards the gas spring 7 the force-free displacement range 15 comes into effect in that the sleeve 12 shifts on the cylinder 14. This second open position is stable solely by the gas spring 4. In closing the lid 2 a force is exerted upon the lid 2 in which firstly the outward thrust force of the gas spring 4 has to be overcome and then also the outward thrust force of the gas spring 7 after the first position is reached.

By reason of the geometry of installation of the gas springs 4 and 7 and the weight of the lid 2 to be supported, according to its open position in each case, the above-described gas spring combination of a long-stroke gas spring and a short-stroke gas spring having an additional pressure-free displacement range produces a very simple solution for holding a pivotable part in two stable open positions. Of course it is readily possible to assemble this gas spring combination in a construction unit, such a construction unit comprising the two gas springs as illustrated in FIGS. 1 and 2 and fastening members hingedly connected to both respective end portions of the gas spring and adapted for being fastened to the housing 1 and to the lid 2. Furthermore by modification of the gas spring 4 it is possible to achieve the object that further stable holding positions can be produced between the first and second open positions of the lid 2. This can be achieved for example by the known stroke-dependently acting locking devices for the transfer passages as illustrated for example in Fed. German Publ. Spec. No. 2,513,302.

Figure 3:
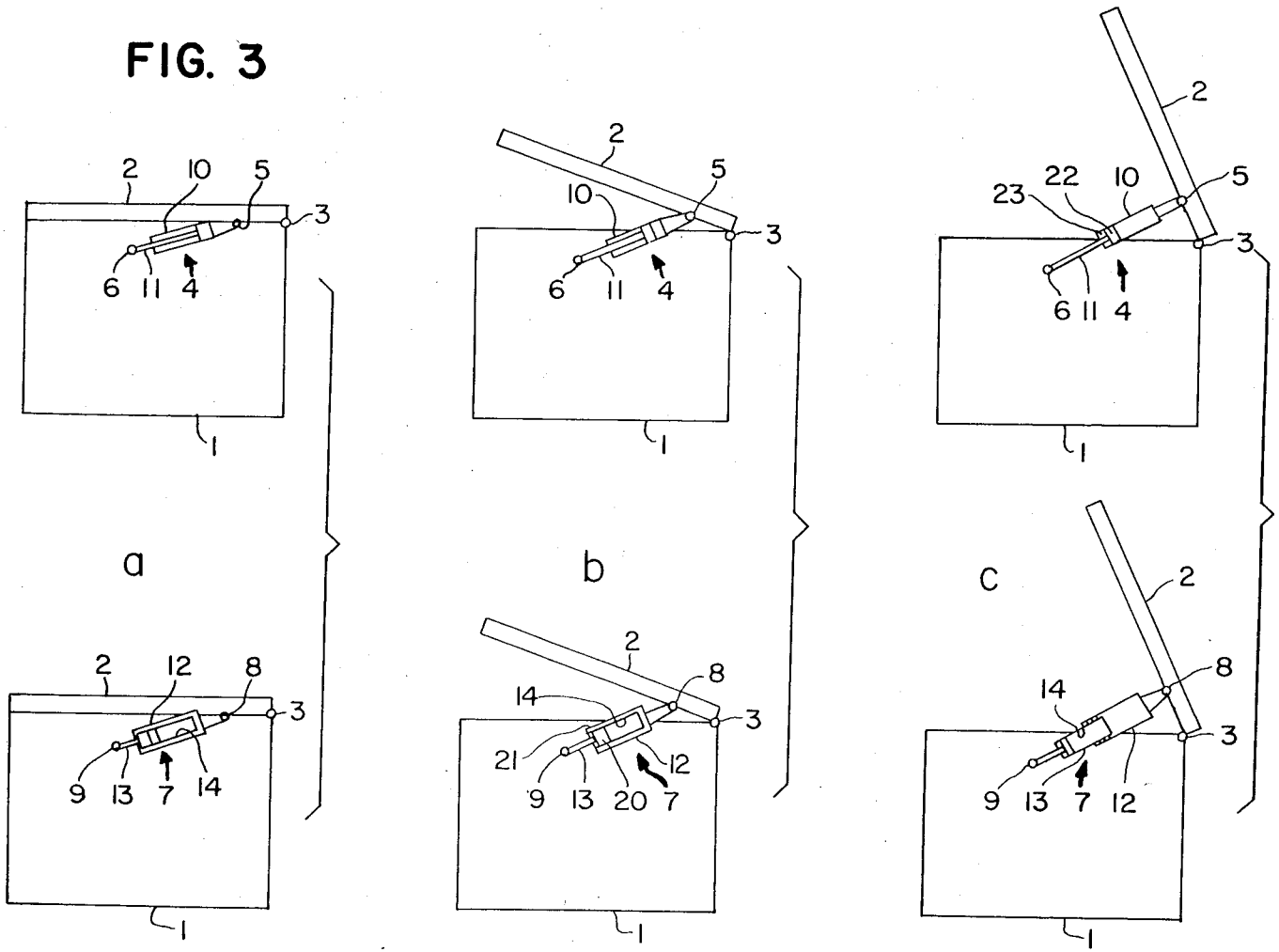
FIG. 3 shows in diagrammatic way the movement of the pivotable part from the fully closed through the partially opened to the fully opened holding position with the respective positions of a first gas spring in the upper line and the corresponding positions of the second gas spring in the lower line.

In FIG. 3 the behaviour of the construction as shown in FIGS. 1 and 2 is illustrated in diagrammatic way. The upper line shows a part of the construction with the gas spring 4 and the lower line shows the part of the construction comprising the gas spring 7. In the position a (not shown in FIGS. 1 and 2) the lid 2 is fully closed and in a substantially horizontal position. In this position the added forces of the gas springs 4 and 7 are not sufficient to overcome the moment of the weight of the lid 2 acting around the axis 3. This is due to the geometrical position of the joints 5, 6 and 8, 9. Due to this geometrical arrangement the moment of the added gas spring forces around the axis 3 is small as a result of the short lever arm between the action lines of the gas springs 4 and 7 and the axis 3. So a stable position is obtained even without locking means locking the lid 2 in the closed substantially horizontal position.

In order to reach the position b (corresponding to FIG. 1) a small opening moment is to be exerted onto the lid 2, this manual force assisting the opening moment exerted by the gas springs 4 and 7. After a short angular movement towards the position b the lever arm of the gas springs 4 and 7 with respect to the axis 3 is such that the lid can be further moved towards the position b solely by the combined action of the gas springs 4 and 7. In the position b the gas spring 7 has arrived at its maximum length in that e.g. the piston 20 of the gas spring 7 abuts the end wall 21 of the cylinder 14. Now the gas spring 7 cannot further exert a force and a moment about the axis 3. The force of the gas spring 4 is selected so that the moment exerted by this force alone about the axis 3 is not sufficient to further open the lid 2. Therefore the position b is also a stable position.

In order to achieve—starting from the position b—the position c it is again necessary to exert a small opening force onto the lid 2. When moving the lid 2 from the position b to the position c by manual force assisting the force of the gas spring 4 the lever arm between the gas spring 4 and the axis 3 is again increased and the moment of the weight of the lid 2 about the axis 3 is again reduced so that before the position c is reached the moment of the gas spring 4 about the axis 3 overcomes the moment exerted by the weight of the lid 2 about the axis 3. Therefore the terminal range of movement between positions b and c adjacent position c can be obtained solely by the action of the gas spring 4. In position c finally the outward stroke of the piston rod 11 with respect to the cylinder 10 is terminated e.g. by abutment of the piston 22 at an end wall 23 of the cylinder 10. So position c is again a stable one. It is to be noted that during the range of movement from position b to position c the sleeve 12 slides on the cylinder 13.

It is to be noted that a sleeve slidingly mounted on a cylinder of a gas spring is known from Fed. German Publ. Spec. No. 2,849,267, page 5.

While a specific embodiment of the invention has been shown and described in detail to illustrate the application of the inventive principle, it will be understood that the invention may be embodied otherwise without departing from such principles.

The reference numerals in the claims are only used for facilitating the understanding and are by no means restrictive.

What is claimed is:

1. A mechanical structure comprising a basic unit (1) and a pivotable part (2) mounted on said basic unit (1) for pivotable movement about a substantially horizontal axis (3) from a first stable position (a) through a second stable position (b) to a third stable position (c), gas spring units (4, 7) being hingedly connected to both said basic unit (1) and said pivotable part (2) about hinge axes (5, 6, 8, 9) substantially parallel to said horizontal axis (3), a first one (4) of said gas spring units (4, 7) having an active stroke corresponding to pivot movement of said pivotable part (2) from said first stable position (a) to said third stable position (c) and exerting a torque onto said pivotable part (2) during said active stroke, said torque biasing said pivotable part (2) towards said third stable position (c), a second one (7) of said gas spring units (4, 7) having an active stroke corresponding to the pivot movement of said pivotable part (2) from said first stable position (a) to said second stable position (b), such as to exert a torque onto said pivotable part (2) during its movement from said first stable position (a) to said second stable position (b), said torque biasing said pivotable part (2) towards said second stable position (b), said second gas spring unit (7) further having a dead stroke corresponding to the pivot movement of said pivotable part (2) from said second stable position (b) to said third stable position (c), such as to exert no torque onto said pivotable part (2) during its pivot movement from said second stable position (b) to said third stable position (c), said pivotable part (2) being in said second stable position (b) subject to a gravity torque, said gravity torque in said second stable position (b) acting towards said first stable position (a) and being in balance with the torques exerted by both gas spring units (4, 7) in that the gravity torque is insufficient to overcome the torques exerted by said two gas springs towards said second stable position (b) and as to exceed the torque of said first gas spring unit (4) biasing said pivotable part (2) towards said third stable position (c).

2. A structure as in claim 1, said pivotable part (2) also being subject in said third stable position to a gravity torque biasing it towards said first stable position, said gravity torque being exceeded by the torque exerted by said first gas spring unit (4) in said third stable position (c).

3. A structure as in claim 1, said pivotable part (2) also being subject in said first stable position to a gravity torque biasing it toward said first stable position, the combined torques of said gas spring units (4, 7) in said first stable position being insufficient to overcome said gravity torque.

4. A structure as in claim 1, said dead stroke of said second gas spring unit (7) being obtained by a telescopic member (12) freely slidable on one of a cylinder (14) and a piston rod (13) of said second gas spring unit (7), said telescopic member (12) being hingedly connected to one of said basic unit (1) and said pivotable member (2).

5. A structure as in claim 1, said third stable position being defined by abutment means said first gas spring unit (4) biasing engagable parts (22, 23) of said abutment means towards mutual engagement.

6. A structure as in claim 5, said abutment means (22, 23) being integrated within said first gas spring unit (4).

7. A structure as in claim 6, said abutment means being established by a piston member (22) and an end wall (23) of a cylinder (10) of said first gas spring unit (4).

8. A structure as in claim 1, said active stroke of said second gas spring unit (7) being limited in said second stable position by abutment means (20, 21) integrated within said second gas spring unit (7).

9. A structure as in claim 8, said abutment means being established by a piston member (20) and an end wall (21) of a cylinder (14) of said second gas spring unit (7).

10. A structure as in claim 1, said pivotable member (2) being a cover member in relation to said basic unit (1).

* * * * *